US011617037B2

(12) United States Patent
Ma

(10) Patent No.: US 11,617,037 B2
(45) Date of Patent: Mar. 28, 2023

(54) HEARING DEVICE WITH OMNIDIRECTIONAL SENSITIVITY

(71) Applicant: GN Hearing A/S, Ballerup (DK)

(72) Inventor: Changxue Ma, Barrington, IL (US)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 17/244,756

(22) Filed: Apr. 29, 2021

(65) Prior Publication Data

US 2022/0369029 A1 Nov. 17, 2022

(51) Int. Cl.

| | |
|---|---|
| ***H04R 3/00*** | (2006.01) |
| ***H04R 3/04*** | (2006.01) |
| ***H04R 5/04*** | (2006.01) |
| *H04R 25/00* | (2006.01) |

(52) U.S. Cl.

CPC ..... *H04R 3/04* (2013.01); *H04R 3/005* (2013.01); *H04R 5/04* (2013.01)

(58) Field of Classification Search

None

See application file for complete search history.

(56) References Cited

U.S. PATENT DOCUMENTS

| | | | | |
|---|---|---|---|---|
| 10,425,745 | B1 | 9/2019 | Merks et al. | |
| 2004/0252852 | A1 | 12/2004 | Taenzer | |
| 2010/0135500 | A1* | 6/2010 | Derleth | H04R 25/552 381/23.1 |
| 2014/0314260 | A1 | 10/2014 | Aubreville et al. | |
| 2020/0204927 | A1 | 6/2020 | As'ad et al. | |

FOREIGN PATENT DOCUMENTS

| | | |
|---|---|---|
| EP | 3499915 | 6/2019 |
| WO | WO 2008/006401 | 1/2008 |
| WO | WO 2014/198332 | 12/2014 |
| WO | WO 2020/035158 | 2/2020 |
| WO | WO 2021/063873 | 4/2021 |

OTHER PUBLICATIONS

1st examination report for Danish patent application No. PA202170272 dated Feb. 22, 2022.

(Continued)

*Primary Examiner* — James K Mooney

(74) *Attorney, Agent, or Firm* — Vista IP Law Group, LLP

(57) ABSTRACT

A method performed by a first hearing device comprising microphone(s) configured to generate a first input signal, a communication unit configured to receive a second input signal from a second hearing device, an output unit, and a processor, the method comprising: generating a first intermediate signal including or based on a first weighted combination of the first input signal and the second input signal, wherein the first weighted combination is based on a first gain value and/or a second gain value; and generating an output signal for the output unit based on the first intermediate signal; wherein one or both of the first gain value and the second gain value are determined in accordance with an objective of making a power of the first input signal and a power of the second input signal differ by a preset power level difference greater than 2 dB in the weighted combination.

17 Claims, 5 Drawing Sheets

(56) References Cited

OTHER PUBLICATIONS

Extended European Search Report for EP Patent Appln. No. 21175990.7 dated Nov. 18, 2021.

As'ad Hala et al: "Binaural beamforming with spatial cues preservation for hearing aids in real-life complex acoustic environments". 2017 Asia-Pacific Signal and Information Processing Association Annual Summit and Conference (APSIPA ASC). IEEE. Dec. 12, 2017 (Dec. 12, 2017). pp. 1390-1399. XP033315634. DOI: 10.1109/APSIPA.2017.8282250 [retrieved on Feb. 5, 2018] * the whole document *.

* cited by examiner

HEARING DEVICE WITH OMNIDIRECTIONAL SENSITIVITY

FIELD

The subject disclosure relates to hearing devices and methods performed by hearing devices. At least one embodiment described herein is directed to a method performed by a first hearing device comprising a first input unit including one or more microphones and being configured to generate a first input signal, a communications unit configured to receive a second input signal from a second hearing device, an output unit; and a processor coupled to the first input unit, the communication unit and the output unit.

BACKGROUND

People with normal hearing are generally capable of selectively paying attention to a particular speaker to achieve speech intelligibility and to maintain situational awareness under noisy listening conditions such as restaurants, bars, concert venues etc.. In the field of hearing instruments this is sometimes referred to as so-called cocktail party scenarios.

People with normal hearing are natively capable of utilizing a better-ear listening strategy where an individual focusses his or her attention on the speech signal of the ear with the best signal to noise ratio for the target talker or speaker, i.e. a desired sound source. This, native, better-ear listening strategy can also allow for monitoring off-axis unattended talkers by cognitive filtering mechanisms, such as selective attention.

In contrast, it remains a challenging task for hearing impaired individuals to listen to a particular, desired, sound source in such noisy sound environments and at the same time maintain environmental awareness by monitoring off-axis or unattended talkers. Hence, it is desirable to provide similar hearing capabilities to hearing impaired individuals for example by exploiting well-known spatial filtration capabilities of existing binaural hearing aid systems. However, the use of binaural hearing aid systems and associated beamforming technology often focuses on increasing or improving a signal to noise ratio (SNR) of a bilaterally or binaurally beamformed microphone signal or signals for incoming sounds at a particular target direction, often in front of the individual or at another target direction, at the expense of decreasing the audibility of the unattended, often off-axis located, talkers in the sound environment. The signal to noise ratio improvement of the binaurally beamformed microphone signal is caused by a high directivity index of the binaurally beamformed microphone signal which means that sound sources placed outside, off-axis, a relatively narrow angular range around the selected target direction are heavily attenuated or suppressed. This property of the binaurally beamformed microphone signal leads to an unpleasant so-called "tunnel hearing" sensation for the hearing-impaired individual or patient/user where the latter loses situational awareness.

There is a need in the art for binaural hearing aid systems which provide hearing impaired individuals with improved speech intelligibility in cocktail party sound environments, or similar adverse listening conditions, but without sacrificing off-axis awareness to provide increased situational awareness relative to prior art comparable directional hearing aid systems. One problem, related to use of hearing devices with directional sensitivity, is that either directional sensitivity is engaged, which gives some useful advantages like spatial noise reduction, or that omnidirectional sensitivity is engaged to enable hearing from multiple directions. However, omnidirectional sensitivity usually comes at the cost of an increased noise level.

There are various beamforming algorithms available to perform spatial filtering with microphones receiving sound waves differing in time of arrivals. For listening devices, the acoustic wave, however, is filtered by the head before reaching the microphones, which is often referred as the head shadowing effect. Due to the head shadowing effect, however, the relative level between a left signal captured by a left-ear device and a right signal captured by a right-ear device varies significantly depending on the direction to the source, e.g. persons talking.

The higher the sound frequency is, the stronger the head shadow effects. Generally, beamforming algorithms, which assumes free field propagation of sound waves, needs to be improved to appropriate compensate for the head shadow effect.

SUMMARY

In connection with some binaural hearing systems one hearing device, e.g. a right ear hearing device provides a monitor signal, which has at least approximately an omnidirectional directivity, and a second hearing device, e.g. a left hearing device provides a focussed signal, which exhibit maximum sensitivity in a target direction, e.g. at the user's look direction, and reduced sensitivity at the left and right sides. Such a binaural hearing system can at least reduce the above-mentioned unpleasant "tunnel hearing" sensation. However, it is observed that at least some users of hearing devices still experience problems in situations where multiple speakers are present. In particular, it is observed that there is a need for improvements related to providing the quality of a monitor signal e.g. in connection with a binaural hearing system. Herein, the hearing device generating the monitor signal is denoted an ipsilateral device and the hearing device generating the focussed signal is denoted a contralateral device.

There is provided:

A method performed by a first hearing device; the first hearing device comprising a first input unit including one or more microphones and being configured to generate a first input signal (l), a communication unit configured to receive a second input signal (r) from a second hearing device, an output unit (140); and a processor coupled to the first input unit, the communication unit and the output unit, the method comprising:

determining a first gain value ($\alpha$), a second gain value ($1-\alpha$) or both of the first gain value ($\alpha$) and the second gain value ($1-\alpha$);

generating a first intermediate signal (v) including or based on a first weighted combination of the first input signal (l) and the second input signal (r); wherein weighing into the weighted combination is based on the first gain value ($\alpha$), the second gain value ($1-\alpha$), or both of the first gain value ($\alpha$) and the second gain value ($1-\alpha$); and generating an output signal (z) for the output unit (140) based on the first intermediate signal;

wherein one or both of the first gain value ($\alpha$) and the second gain value ($1-\alpha$) are determined in accordance with an objective of making the power of the first input signal (l) and the power of the second input signal (r) differ by a preset power level difference (d) greater than 2 dB in the weighted combination at least at times when the power of the first input signal (l) and the power of the second input signal (r) differ less than 6 dB.

An advantage is that a significant improvement in acoustic fidelity is enabled at least when compared to methods involving selection between directionally focussed sensitivity and omnidirectional sensitivity. In particular a wearers experience improvements in social settings, where a user may want to listen to—or be able to listen to more than one person, and at the same time enjoy reduction of noise from the surroundings.

In particular it is observed that the claimed method achieves a desired trade-off which enables a directional sensitivity, e.g. focussed at an on-axis target signal source, while at the same time enabling that an off-axis signal source to be heard, at least with better intelligibility. Listening tests has revealed that users experience less of a 'tunnel-effect' when provided with a system employing the claimed method.

Despite the undesired 'tunnel-effect' being suppressed or reduced, off-axis noise suppression is improved, as evidenced by an improved directionality index. This is also true, in situations where an off-axis target signal source is present.

Further, measurements show that a directivity index is improved over a range of frequencies, at least in the frequency range above 500 Hz and, in particular, in the frequency range above 1000 Hz.

The method enables that directionality of the hearing device can be maintained, despite the presence of an off-axis target sound source.

Rather than employing a method of entering an omnidirectional mode to capture the off-axis target sound source or alternatively suppressing the off-axis target sound source due to the directionality, a signal from an off-axis sound source is reproduced at the acceptable cost that the signals from an on-axis sound source is slightly suppressed, however only proportionally to the strength of signal from the off-axis sound source. Since the signals from an on-axis sound source are slightly suppressed, proportionally to the strength of signal from the off-axis sound source, the signals from the off-axis sound source can be perceived.

Thus, in some aspects, the method comprises forgoing automatically entering an omnidirectional mode. In particular, it is thereby avoided that the user is exposed to a reproduced signal in which the noise level increases when entering the omnidirectional mode.

At least in some aspects, the method is aimed at utilizing the head shadow effect on beamforming algorithms by scaling the first signal and the second signal. The scaling—or equalization of the first signal relative to the second signal or vice versa—is estimated from the first signal and the second signal.

An advantage is that a sometimes observed comb effect is reduced or substantially eliminated.

The method can be implemented in different ways. In some aspects the first gain value and the second gain value are not frequency band limited i.e. the method is performed at one frequency band, which is not explicitly band limited. In other aspects, the first gain value and the second gain value are associated with a band limited portion of the first signal and the second signal. In some aspects, multiple first gain values and respective multiple second gain values are associated with respective band limited portions of the first signal and the second signal. In some aspects, the first gain value and the second gain value are comprised by respective arrays of multiple gain values at respective multiple frequency bands or frequency indexes, sometimes denoted frequency bins. In some aspects, prior to summation, the first gain value scales the amplitude of the first signal to provide a scaled first signal and the second gain value scales the amplitude of the second signal to provide a scaled second signal. Then the scaled first signal and the scaled second signal are combined by addition.

In other aspects, the first gain value scales the amplitude of the first signal to provide a scaled first signal, which is combined, by addition, with the second signal to provide a combined signal. Then, the combined signal is scaled by the second gain value. The method may include forgoing scaling by the second gain value.

In some aspects, the combination is provided by summation e.g. using an adder, or by an alternative, e.g. equivalent, method.

In some aspects, the weighted combination is obtained by mixing the first input signal, scaled by the first gain value, and the second input signal, scaled by the second gain value. In some aspects the intermediate signal is a single-channel signal or monaural signal. The Single channel signal may be a discrete time domain signal or a discrete frequency domain signal.

In some aspects the combination of the first directional input signal and the second directional input signal, is a linear combination.

As an illustrative example, the ipsilateral hearing device and the contralateral hearing device are in mutual communication, e.g. wireless communication, such that each of the ipsilateral hearing device and the contralateral hearing device are able to process the first directional input signal and the second directional input signal, wherein one of the signals is received from the other device. The signals may be streamed bi-directionally, such that the ipsilateral device receives the second signal from the contralateral device and such that the ipsilateral device transmits the first signal to the contralateral device. The transmitting and receiving may be in accordance with a power saving protocol.

As an illustrative example, the method is performed concurrently at the ipsilateral hearing device and at the contralateral hearing device. In this respect, the respective output units at the respective devices presents the output signals to the user as monaural signals. The monaural signals are void of spatial cues in respect of deliberately introduced time delays to add spatial cues.

In some examples, the output signal is communicated to the output unit of the ipsilateral hearing device.

As another illustrative example, each of the ipsilateral hearing device and the contralateral hearing device comprises one or more respective directional microphones or one or more respective omnidirectional microphones including beamforming processors to generate the signals.

As a further illustrative example, each of the first signal and the second signal is associated with a fixed directionality relative to the user wearing the hearing devices. Herein, an on-axis direction may refer to a direction right in front of the user, whereas an off-axis direction may refer to any other direction e.g. to the left side or to the right side. In some aspects, a user may select a fixed directionality, e.g. at a user interface of an auxiliary electronic device in communication with one or more of the hearing devices. In some embodiments, directionality may be automatically selected e.g. based on focussing on a strongest signal.

In some examples, the method includes combining the first signal and the second signal from monaural, fixed beamformer outputs of the ipsilateral device and the contralateral device, respectively, to further enhance the target talker.

The method may be implemented in hardware or a combination of hardware and software. The method may include one or both of time-domain processing and frequency-domain processing. The method encompasses embodiments using iterative estimation of the first gain value and/or the second gain value, and embodiments using deterministic computation of the first gain value and/or the second gain value.

In some aspects one or both of the first input signal and the second input signal is an omnidirectional input signal or a hypercardioid input signal. In some aspects one or both of the first input signal and the second input signal is/are a directional input signal. In some aspects one or both of the first input signal and the second input signal is/are a directional input signal with a focussed directionality.

In some aspects at least one of the microphones is arranged as a microphone in the ear canal, MIE. Despite being arranged in the ear canal, the microphone is able to capture sounds from the surroundings.

In some aspects, the first gain value and the second gain value sums to the value '1.0'. Thereby the power level of the monitor signal is not boosted by mixing the first and the second input signal.

In some aspects, the method is performed by a system comprising the first hearing device and a second hearing device. The second hearing device comprising a first input unit including one or more microphones and being configured to generate a first input signal, a communication unit configured to receive a second input signal from a second hearing device, an output unit; and a processor coupled to the first input unit, the communication unit and the output unit.

In some embodiments the preset power level difference (d) is greater than or equal to 3 dB, 4 dB, 5 dB or 6 dB in the weighted combination.

In some embodiments the preset power level difference (d) is equal to or less than 6 dB, 8 dB, 10 dB or 12 dB in the weighted combination.

In some examples the preset power level difference is in the range of 6 to 9 dB. This power level difference provides a good reduction of the comb-like signal components in the intermediate signal and the output signal.

The preset power level difference, d, corresponds to a difference in gain, g, by $d=20\cdot\log_{10}(1/g^2)$. In one example, $1/g^2=0.45$ corresponds to preset power level difference being substantially equal to 7 dB. That is, the omnidirectional signal from one side of the wearer's head is about 7 dB stronger than the omnidirectional signal from the other side is the wearer's head.

In some examples the preset power level difference is hard or soft programmed into the first hearing device. In some examples, the preset power level difference has a default value. In some examples the preset power level difference is received via a user interface of an electronic device, such as a general purpose computer, smartphone, tablet computer etc., which is connected, e.g. via a wireless connection, to the first hearing device.

In some embodiments the method comprises:

generating the first intermediate signal (v) including or based on the weighted combination of the first input signal (l) and the second input signal (r) such that the input signal (l; r) with the highest power level ($P_{max}$) remains the signal with the highest power level in the weighted combination at least at times when the power ($P_l$) of the first input signal (l) and the power ($P_r$) of the second input signal (r) differ less than 6 dB.

An advantage is that the method, performed by a first hearing device, outputs a lower level of artefacts and distortion in the output signal. The wearer may experience a more stable reproduction of the omnidirectional sound image. It follows that the input signal (l; r) with the lowest power level ($P_{min}$) remains the signal with the lowest power level in the weighted combination.

In some aspects the method comprises determining a highest power level ($P_{max}$) and a lowest power level ($P_{min}$) based on the first input signal (l) and the second input signal (r). In some examples, this comprises determining the power level ($P_l$) of the first input signal and the power level ($P_r$) of the second input signal.

In some aspects the method comprises determining which of the first signal and the second signal that has the greatest power level ($P_{max}$) and which of the first signal and the second signal that has the lowest power level ($P_{min}$).

In an example the input signal with the highest power level is multiplied by the largest gain value among the first gain value ($\alpha$) and a second gain value ($1-\alpha$). Accordingly, the input signal with the lowest power level is multiplied by the other (smallest) gain value.

In some examples the power of the first input signal and the power of the second input equal signal are substantially at the same level and anyone of the first gain value and the second gain value may be used for e.g. the (slightly) strongest signal.

In some embodiments the method comprises:

generating a second intermediate signal (va) including or based on a second weighted combination of the first input signal (l) and the second input signal (r) in accordance with the first gain value ($\alpha$) and the second gain value ($1-\alpha$), respectively;

generating a third intermediate signal (vb) including or based on a third weighted combination of the first input signal (l) and the second input signal (r) in accordance with the second gain value ($1-\alpha$) and the first gain value ($\alpha$), respectively;

generating the first intermediate signal (v) including or based on a fourth weighted combination of the second intermediate signal (va) and the third intermediate signal (vb) in accordance with a first output value (gx) and a second output value (1−gx) based on a mixing function;

wherein the mixing function transitions smoothly or in multiple steps between a first limit value ('0') and a second limit value ('1') as a function of a difference between or a ratio of the power ($P_l$) of the first input signal (l) and the power ($P_r$) of the second input signal (r).

An advantage is that artefacts and distortions can be reduced. In particular artefacts and distortions can be reduced in situations wherein the power level of the two input signals are about the same, e.g. frequently altering between one or the other having the greatest power level. The function may serve to suppress such frequent alterations and thereby reduce artefacts and distortions in the intermediate signal and/or the output signal. The wearer may experience a more stable reproduction of the omnidirectional sound image. In particular, the mixing function serves to provide a soft decision in determining (deciding) the highest and lowest power level.

In some examples the first limit value is 0 and the second limit value is 1. In some examples the function is the Sigmoid function or another function. The Sigmoid function may be defined as follows:

$$S(x) = \frac{1}{1+e^x}$$

wherein x=k·ln(R), wherein $$R = \sqrt{\frac{P_l}{P_r}}$$

wherein k is a number e.g. larger than 3, e.g. 4 to 10. If the power levels are close to being equal and alternates between one being larger than the other, the output of the mixing function remains substantially unchanged. Thereby generation of artefacts are suppressed. Greater changes in power level difference, causing alteration in which signal that has the greatest power, causes more pronounced changes in the intermediate signal v. Thus, only a relatively great difference in power levels between the first input signal and the second input signal cause the value of the function, S(x), to change significantly.

In some embodiments the method comprises:

determining the power ($P_l$) of the first input signal (l) and determining the power ($P_r$) of the second input signal (r);

determining a highest power level ($P_{max}$) based on the power ($P_l$) of the first input signal (l) and the power ($P_r$) of the second input signal (r) and based on an output value (gx) of a mixing function;

determining a lowest power level ($P_{min}$) based on the power ($P_l$) of the first input signal (l) and the power ($P_r$) of the second input signal (r) and based on a complementary output value (1−gx) of the mixing function;

wherein the mixing function transitions smoothly or in multiple steps between a first limit value ('0') and a second limit value ('1') as a function of a difference between or a ratio of the power ($P_l$) of the first input signal (l) and the power ($P_r$) of the second input signal (r).

An advantage is that one or both of the first gain value (α) and the second gain value (1−α;) can be determined based on a smooth rather than an abruptly changing determination of the highest power level ($P_{max}$) and the lowest power level ($P_{min}$). This is an advantage, in particular in a time-domain implementation, for determining one or both of the first gain value (α) and the second gain value (1−α;) while introducing only a limited amount of artefacts in the intermediate signal and/or the output signal.

The value '1−gx' is complementary with respect to 'gx' in the sense that the sum of the values sums to an at least substantially time-invariant, constant value e.g. '1' or another value greater or less than '1'.

In some embodiments the power ($P_l$) of the first input signal (l) is based on smoothed and squared values of the first input signal (l); and wherein the power ($P_r$) of the second input signal (r) is based on smoothed and squared values of the second directional input signal (r).

An advantage is that sudden loud sounds, e.g. from one side of the wearer's head does not disturb the wearer's perception of the acoustic image, which remains in balance despite sudden loud sounds from some direction.

In some examples, the power, $p_R$, of the first directional input signal ($f_R$) and the power, $p_L$, of the second directional input signal ($f_L$) are computed by the following expressions:

$$P_l(n)=\gamma\cdot P_l(n-1)+(1-\gamma)\cdot l(n)\cdot l(n)$$

$$P_r(n)=\gamma\cdot P_r(n-1)+(1-\gamma)\cdot r(n)\cdot r(n)$$

Wherein γ is a 'forgetting factor' reflecting how much a sum of previous values should be weighted over instantaneous values. Thus, the sudden effect of instantaneous values is reduced. Other methods for providing a smoothened power level estimate may be viable. Here, n designates a time index of individual samples of the signals or frames of samples of the signals.

In some embodiments the first gain value (α) is adjusted to at least converge towards a first gain value, α, at least approximately satisfying the first equation:

$$\frac{\alpha^2 P_{max}}{\beta^2 P_{min}} = \frac{1}{g^2}$$

wherein $p_{max}$ is the power level of the input signal with a highest power level among the first input signal and the second input signal; and wherein $p_{min}$ is the power level of the input signal with a highest power level among the first input signal and the second input signal, β=1−α is the second gain value, and $1/g^2$ corresponds to the preset power level difference.

An advantage is that the observed comb effect is reduced or substantially eliminated while it is enabled that the power level in the intermediate signal and/or the output signal can remain substantially unchanged.

In some aspects weighing into the weighted combination is based on both of the first gain value, α, and the second gain value, β. In some aspects β is at least approximately equal to 1−α. Thereby, the power of a weighted sum of the first directional input signal and the second directional input signal is at least approximately equal to the sum of the first directional input signal and the second directional input signal.

In some embodiments the first gain value, α, is determined based on the following expression or an approximation thereof:

$$\alpha = \frac{\sqrt{P_{max}}}{g\sqrt{P_{max}} + \sqrt{P_{min}}}$$

wherein $P_{max}$ is the highest power level based on the power ($P_l$) of the first input signal (l) and the power ($P_r$) of the second input signal (r); $P_{min}$ is the lowest power level based on the power ($P_l$) of the first input signal (l) and the power ($P_r$) of the second input signal (r); and g is a gain factor corresponding to the preset power level difference (d).

An advantage is that at least the first gain value, α, and, easily, the second gain value, β, can be determined expediently and continuously in a time-domain implementation.

The highest power level and the lowest power level are expediently determined as set out in the above. Alternatively, or additionally highest power level and the lowest power level are determined in another way e.g. by computing the power level over consecutive and/or time overlapping frames of concurrent segments of the first input signal and the second input signal.

In some embodiments the method comprises:

recurrently, at least at a first time and a second time, determining a current value ($\alpha_n$) of one or both of the first gain value and the second gain value;

wherein the current value ($\alpha_n$) of the first gain value is determined iteratively in accordance with:

i. an estimate of first gain value ($\alpha$) satisfying the objective of making the power of the first input signal (l) and the power of the second input signal (r) differ by a preset power level difference (d) greater than 2 dB in the weighted combination, and ii. a previous value ($\alpha_{n-1}$) of the first gain value plus an iteration step value which is based on the estimate of first gain value ($\alpha$) and the previous value ($\alpha_{n-1}$).

An advantage is that the method, performed by a first hearing device, outputs a lower level of artefacts and distortion in the output signal. The wearer may experience a more stable reproduction of the omnidirectional sound image.

The iterative determining the current value of one or both of the first gain value and the second gain value enforces a smooth development over time in the value(s) of one or both of the first gain value and the second gain value.

In some examples, the current value, $\alpha_n$, of the first gain value is iteratively determined by the below expression:

$$\alpha_n=\alpha_{n-1}+\text{stepSize}*(\alpha-\alpha_{n-1})$$

wherein the stepSize is a numerical value, e.g. a fixed value. The term ($\alpha-\alpha_{n-1}$) represents the gradient for iteratively determining $\alpha_n$.

In some examples, the preset power level difference (d) is about 6 dB corresponding, at least approximately to g=0.25. Then, in situations when the power level of the first input signal and the power level of the second input signal are equal or substantially to equal, the first gain value will converge to $$\alpha = \frac{1}{g+1} = 0.8 \text{ and } (1-\alpha) = 0.2.$$

However, this is for situations when power level of the first input signal and the power level of the second input signal have remained equal or substantially to equal.

For the sake of completeness, the first gain value ($\alpha$) can be determined based on a quadratic equation, wherein the first gain value ($\alpha$) is an unknown value, and wherein known values include the first pre-set power level difference (g), the power of the first directional input signal ($p_L$), and the power of the second directional input signal ($p_R$). However, this approach is possibly less optimal as it is based on an assumption of stationary power levels.

In some embodiments the method comprises:

delaying one the first directional input signal (l) and the second directional input signal (r) to delay the first directional input signal (l) or the second directional input signal (r) relative to the second directional input signal (r) or the first directional input signal (l), respectively.

An advantage is that the comb effect is reduced or substantially eliminated.

In some examples, the delay, r, introduced between the first directional input signal and the second directional input signal is in the range of 3 to 17 milliseconds; e.g. 5 to 15 milliseconds. The delay, $\tau$, is effective in reducing the comb effect. In particular, it is observed that constructive interference and echoes are reduced. In particular, it is observed that spatial zones with either constructive or destructive interference can be avoided.

In some embodiments the method comprises:

recurrently determining the first gain value ($\alpha$), the second gain value ($1-\alpha$), or both of the first gain value ($\alpha$) and the second gain value ($1-\alpha$), based on a non-instantaneous level of the first directional input signal (l) and a non-instantaneous level of the second directional input signal (r).

An advantage thereof is that less distortion and less hearable modulation artefacts are introduced when recurrently determining one or both of the first gain value ($\alpha$) and the second gain value ($1-\alpha$).

The non-instantaneous level of the first directional input signal and the non-instantaneous level of the second directional input signal may be obtained by computing, respectively, a first time average over an estimate of the power of the first directional input signal and a second time average over an estimate of the power of the first directional input signal. The first time average may be a moving average.

The non-instantaneous level of the first directional input signal and the non-instantaneous level of the second directional input signal may be proportional to: a one-norm (1-norm) or a two-norm (2-norm) or a power (e.g. power of two) of the respective signals.

The non-instantaneous level of the first directional input signal and the non-instantaneous level of the second directional input signal may be obtained by a recursive smoothing procedure. The recursive smoothing procedure may operate at the full bandwidth of the signal or at each of multiple frequency bins. For instance, in a frequency domain implementation, the recursive smoothing procedure may smooth at each bin across short time Fourier transformation frames e.g. by a weighted sum of a value in a current frame and a value in a frame carrying an accumulated average.

Alternatively, the non-instantaneous level of the first directional input signal and the non-instantaneous level of the second directional input signal may be obtained by a time-domain filter, e.g. an IIR filter.

In some embodiments the first gain value ($\alpha$) and the second gain value ($1-\alpha$) are recurrently determined, subject to the constraint that the first gain value ($\alpha$) and the second gain value ($1-\alpha$) sums to a predefined time-invariant value.

An advantage is that undesired modulations or artefacts are not introduced as a function of changes in the value of the first gain value ($\alpha$) and the second gain value ($1-\alpha$). In some examples, predefined time-invariant value is 1, but other, greater or smaller values can be used.

In some embodiments the method comprises:

processing the intermediate signal (v) to perform a hearing loss compensation.

An advantage is that compensation for a hearing loss can be improved based on the method described herein.

There is also provided:

A hearing device, comprising:

a first input unit including one or more microphones;

a communications unit;

an output unit comprising an output transducer;

at least one processor coupled to: the first input unit, the communications unit and the output unit; and a memory storing at least one program, wherein the at least one program is configured to be executed by the one or more processors, the at least one program including instructions for performing the method.

There is also provided:

A computer readable storage medium storing at least one program, the at least one program comprising instructions, which, when executed by the at least one processor of a hearing device with an input transducer, at least one processor and an output transducer, enables the hearing device to perform the method.

A computer-readable storage medium may be, for example, a software package, embedded software. The computer-readable storage medium may be stored locally and/or remotely.

The term 'processor' may include a combination of one or more hardware elements. In this respect, a processor may be configured to run a software program or software components thereof. One or more of the hardware elements may be programmable or non-programmable.

There is also provided:

A method performed by a first hearing device; the first hearing device comprising a first input unit including one or more microphones and being configured to generate a first input signal, a communication unit configured to receive a second input signal from a second hearing device, an output unit, and a processor coupled to the first input unit, the communication unit, and the output unit, includes: determining a first gain value, a second gain value or both of the first gain value and the second gain value; generating a first intermediate signal including or based on a first weighted combination of the first input signal and the second input signal, wherein the first weighted combination is based on the first gain value, the second gain value, or both of the first gain value and the second gain value; and generating an output signal for the output unit based on the first intermediate signal; wherein one or both of the first gain value and the second gain value are determined in accordance with an objective of making a power of the first input signal and a power of the second input signal differ by a preset power level difference greater than 2 dB in the weighted combination.

Optionally, the preset power level difference is greater than or equal to 3 dB, 4 dB, 5 dB or 6 dB in the weighted combination.

Optionally, the preset power level difference is equal to or less than 6 dB, 8 dB, 10 dB or 12 dB in the weighted combination.

Optionally, the generated first input signal has a higher power than that of the received second input signal, and wherein in the weighted combination, the power of the first input signal is higher than the power of the second input signal.

Optionally, the received second input signal has a higher power than that of the generated first input signal, and wherein in the weighted combination, the power of the second input signal is higher than the power of the first input signal.

Optionally, the method further includes: generating a second intermediate signal including or based on a second weighted combination of the first input signal and the second input signal in accordance with the first gain value and the second gain value, respectively; generating a third intermediate signal including or based on a third weighted combination of the first input signal and the second input signal in accordance with the second gain value and the first gain value, respectively; wherein the first intermediate signal is based on the second intermediate signal and the third intermediate signal in accordance with a first output value and a second output value based on a mixing function; wherein the mixing function transitions smoothly or in multiple steps between a first limit value and a second limit value as a function of a difference between the power of the first input signal and the power of the second input signal, or as a function of a ratio of the power of the first input signal and the power of the second input signal.

Optionally, the method further includes determining the power of the first input signal and determining the power of the second input signal; determining a highest power level ($P_{max}$) based on the power of the first input signal and the power of the second input signal and based on an output value (gx) of a mixing function; determining a lowest power level ($P_{min}$) based on the power of the first input signal and the power of the second input signal and based on a complementary output value (1−gx) of the mixing function; wherein the mixing function transitions smoothly or in multiple steps between a first limit value and a second limit value as a function of a difference between the power of the first input signal and the power of the second input signal, or as a function of a ratio of the power of the first input signal and the power of the second input signal.

Optionally, the power of the first input signal is based on smoothed and squared values of the first input signal; and wherein the power of the second input signal is based on smoothed and squared values of the second input signal.

Optionally, the first gain value satisfies the below equation:

$$\frac{\alpha^2 P_{max}}{\beta^2 P_{min}} = \frac{1}{g^2}$$

wherein $p_{max}$ is the highest power level among the power of first input signal and power of the second input signal; and wherein $P_{min}$ is the lowest power level among the power of the first input signal and the power of the second input signal, $\beta=1-\alpha$ is the second gain value, and $1/g^2$ corresponds to the preset power level difference.

Optionally, the first gain value is determined based on the following equation:

$$\alpha = \frac{\sqrt{P_{max}}}{g\sqrt{P_{max}} + \sqrt{P_{min}}}$$

wherein $P_{max}$ is the highest power level among the power of the first input signal and the power of the second input signal; $P_{min}$ is the lowest power level among the power of the first input signal and the power of the second input signal; and g is a gain factor corresponding to the preset power level difference.

Optionally, the method further includes recurrently, at least at a first time and a second time, determining a current value ($\alpha_n$) of the first gain value, wherein the current value ($\alpha_n$) of the first gain value is determined iteratively in accordance with: an estimate of the first gain value satisfying the objective of making the power of the first input signal and the power of the second input signal differ by the preset power level difference greater than 2 dB in the weighted combination, and a previous value ($\alpha_{n-1}$) of the first gain value plus an iteration step value which is based on the estimate of first gain value and the previous value ($\alpha_{n-1}$).

Optionally, the method further includes delaying one the first input signal and the second input signal to delay the first input signal relative to the second input signal, or to delay the second input signal relative to the first input signal.

Optionally, the method further includes recurrently determining the first gain value, the second gain value, or both of the first gain value and the second gain value, based on a non-instantaneous level of the first input signal and a non-instantaneous level of the second input signal.

Optionally, the first gain value and the second gain value are recurrently determined, subject to a constraint that the first gain value and the second gain value sums to a predefined time-invariant value.

Optionally, the method further includes processing the intermediate signal to perform a hearing loss compensation.

A hearing device, includes: a first input unit including one or more microphones; a communication unit; an output unit comprising an output transducer; at least one processor coupled to the first input unit, the communication unit, and the output unit; and a memory storing at least one program, the at least one program including instructions for causing the at least one processor to perform the method.

A computer readable storage medium stores at least one program, the at least one program comprising instructions, which, when executed by a processor of a hearing device, enable the hearing device to perform the method.

BRIEF DESCRIPTION OF THE FIGURES

A more detailed description follows below with reference to the drawing, in which.

DETAILED DESCRIPTION

Figure 1:
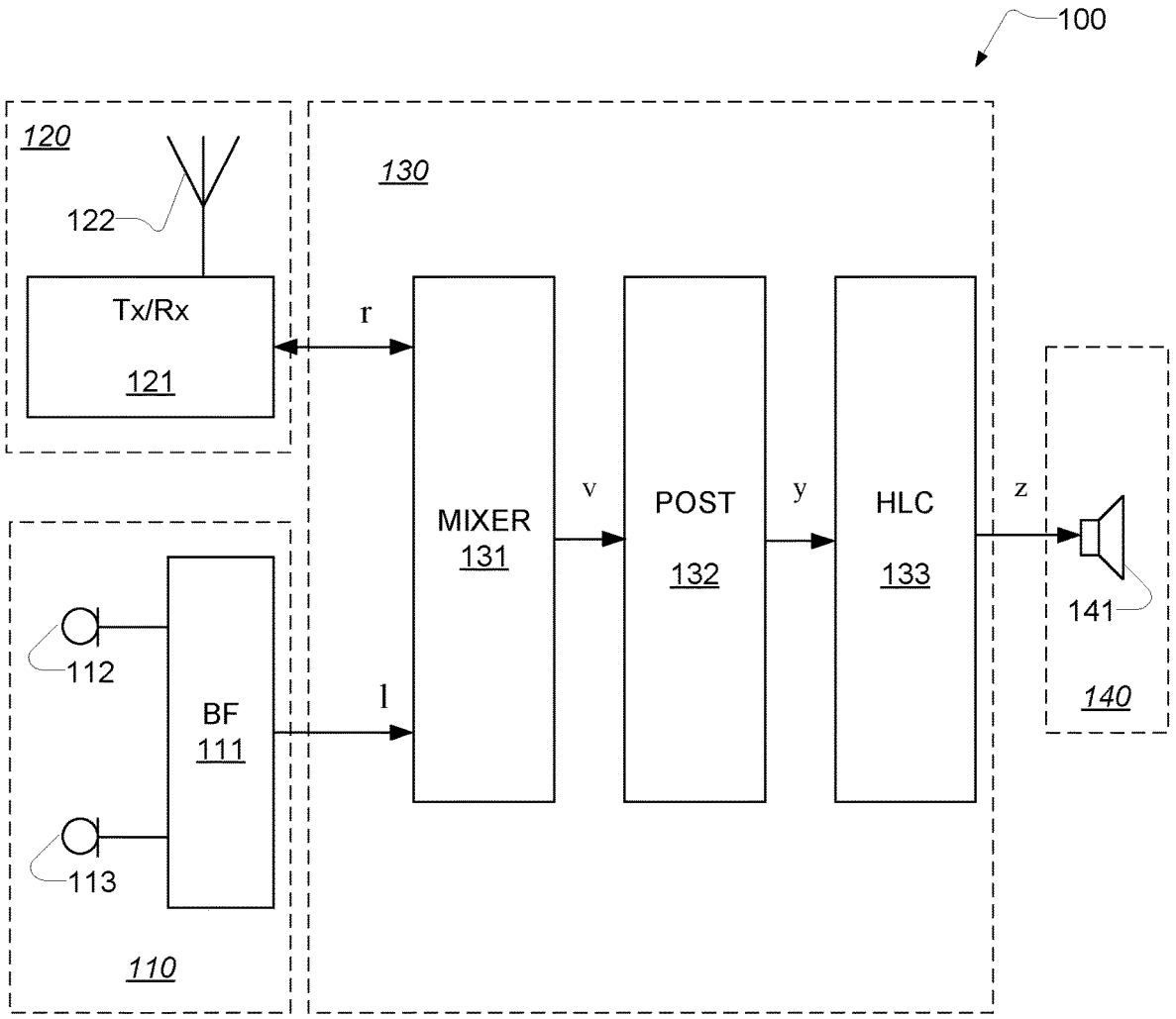
FIG. 1 shows an ipsilateral hearing device with a communications unit for communication with a contralateral hearing device.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 shows an ipsilateral hearing device with a communications unit for communication with a contralateral hearing device (not shown). The ipsilateral heading device 100 generates the monitor signal by means of a loudspeaker 141. The ipsilateral hearing device 100 comprises a communications unit 120 with an antenna 122 and a transceiver 121 for bidirectional communication with the contralateral device. The ipsilateral hearing device 100 also comprises a first input unit 110 with a first microphone 112 and a second microphone 113 each coupled to a beamformer 111 generating a first input signal, l. At least in some embodiments the first input signal, l, is a time-domain signal, which may be designated l(t), wherein t designates time ora time-index. In some examples, the beamformer 111 is a beamformer with a hyper-cardioid characteristic or a beamformer with another characteristic. In some examples the beamformer 111 is a delay-and-sum beamformer. In some examples, the microphone 112 and 113 and optionally additional microphones are arranged in an end-fire or broadside configuration as it is known in the art. In some examples, the beamformer 111 is omitted and instead replaced by one or more microphones with an omnidirectional or hyper-cardioid characteristic. In some examples, the beamformer 111 is capable of selectively running in a non-beamforming mode, in which the first input signal is not beamformed. In some examples, the beamformer 111 is omitted and instead, at least one of the microphones 112 and 113 ora third microphone is arranged as a microphone in the ear canal, MIE. The third microphone and/or the first and second microphones may have an omnidirectional or hypercardioid characteristic. Despite being arranged in the ear canal, the microphone is able to capture sounds from the surroundings.

The communications unit 120 receives a second input signal, r, e.g. from the contralateral hearing device. The second input signal, r, may also be a time-domain signal, which may be designated r(t). At the contralateral device, the second signal r may be captured by an input unit corresponding to the first input unit 110.

For convenience, the first input signal, l, and the second input signal, r, are denoted an ipsilateral signal and a contralateral signal, respectively. In some examples, a first device, e.g. the ipsilateral device, is positioned and/or configured for being positioned at or in a left ear of a user. In some examples, a second device, e.g. a contralateral device, is positioned at or in a right ear of the user. The first device and the second device may have identical or similar processors. In some examples one of the processors is configured to operate as a master and another is configured to operate as a slave.

Figure 6:
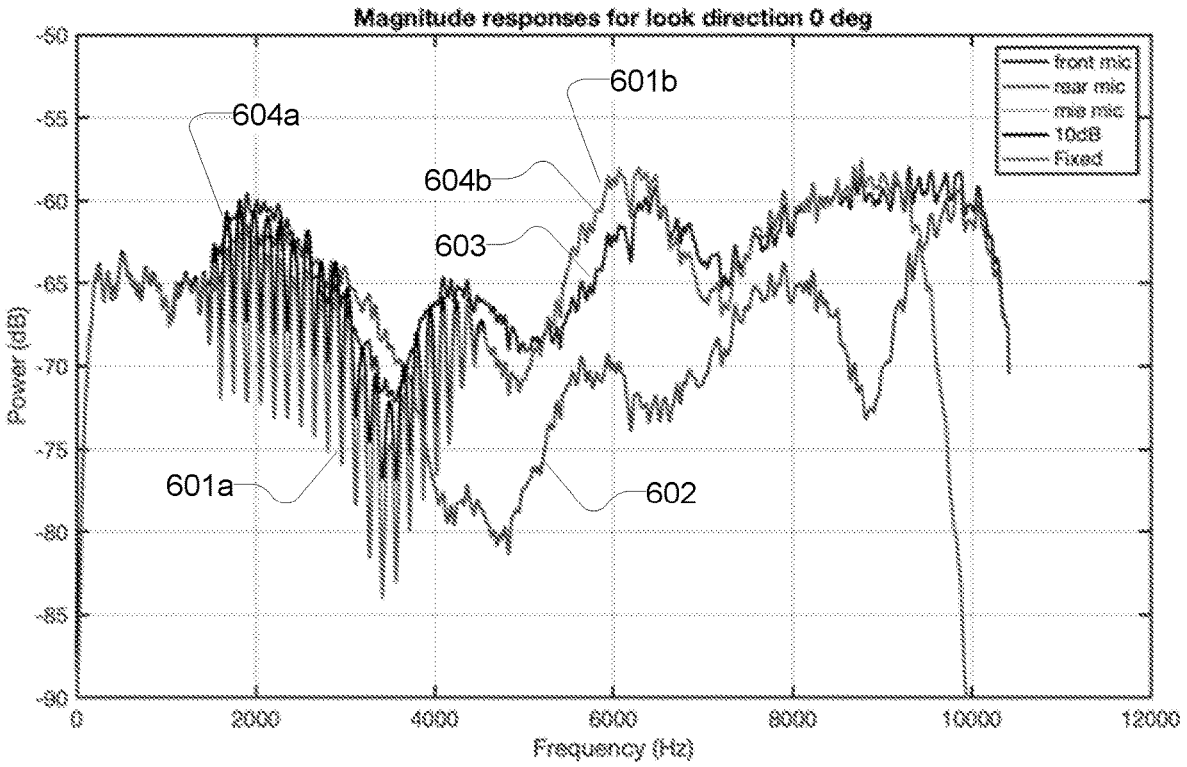
FIG. 6 shows a magnitude response of a monitor signal as a function of frequency.

The first input signal, l, and the second signal, r, are input to a processor 130 comprising a mixer unit 131. The mixer unit 131 may be based on gain units or filters as described in more detail herein and outputs an intermediate signal, v, e.g. designated v(t). The mixer unit 131 is configured to generate the intermediate signal, v, based on a first weighted combination of the first input signal (l) and the second input signal (r) in accordance with a first gain, $\alpha$, value and a second gain value, '$1-\alpha$'. The first gain value, $\alpha$, and the second gain value, '$1-\alpha$' are determined in accordance with an objective of making the power of the first input signal, l, and the power of the second input signal, r, differ by a preset power level difference, d, greater than 2 dB when subjected to the weighing. This has shown to increase fidelity of the monitor signal mentioned in background section. In particular, it has shown to reduce artefacts, such as comb filtering effects, in the intermediate signal. This is illustrated in FIG. 6. The one or more gain values including the gain value $\alpha$ are determined, as described in more detail herein.

In some examples the mixer unit 131 outputs a single-channel intermediate signal v. In some examples, the single-channel intermediate signal is a monaural signal.

In some embodiments, the mixer unit 131 is based on filters, e.g. a multi-tap FIR filters. Each of the input signals, l and r, may be filtered by a respective multi-tap FIR filter before the respectively filtered signals are combined e.g. by summation.

The intermediate signal, v, output from the mixing unit 131 is input to the post-filter 132 which outputs a filtered intermediate signal, y. In some embodiments the post-filter 132 is integrated in the mixer 131. In some embodiments the post-filter 132 is omitted or at least temporarily dispensed with or by-passed.

In some embodiments, the intermediate signal, v, and/or the filtered intermediate signal, y, is input to a hearing loss compensation unit 133, which includes a prescribed compensation for a hearing loss of a user as it is known in the art. The hearing loss compensation unit 133 outputs a hearing-loss-compensated signal, z. In some embodiments, the hearing loss compensation unit 133 is omitted or by-passed.

The intermediate signal, v, and/or the filtered intermediate signal, y, and/or the hearing-loss-compensated signal, z, is input to an output unit 140, which may include a so-called 'receiver' or a loudspeaker 141 of the ipsilateral device for providing an acoustical signal to the user. In some embodiments one or more of the signals v, y and z are input to a second communications unit for transmission to a further device. The further device may be a contralateral device or an auxiliary device.

Although, time domain to frequency domain transformation, e.g. short time Fourier transformation (STFT), and corresponding inverse transformations, e.g. short time inverse Fourier transformation (STIFT), may be used, such transformations are not shown here.

In some examples, the contralateral device 100 includes a further beamformer (not shown) configured with a focussed (high directionality) characteristic providing a further beamformed signal based on the microphones 112 and 113 and optionally additional microphones. The further beamformed signal may be transmitted to the contralateral device (not shown.)

Figure 2:
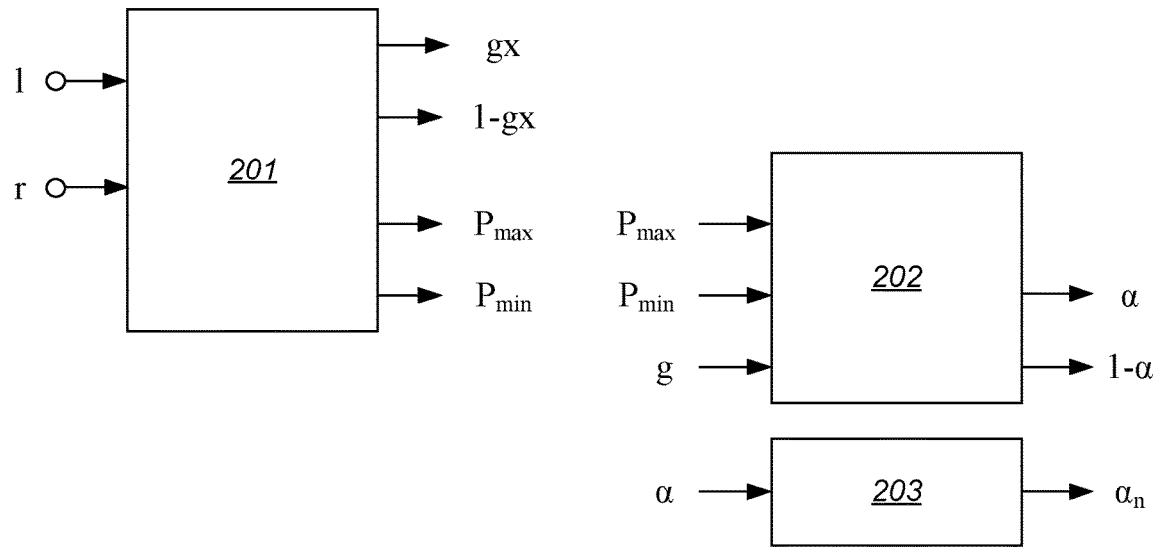
FIG. 2 shows a first, a second and a third processing unit.

More details about the processing, in particular the processing performed by the mixing unit, are given below:

FIG. 2 shows a first, a second and a third processing unit. The processing units may be part of the processor 130 or more specifically a part of the mixer 131. The first processing unit 201 receives the first input signal, l, and the second input signal, r, which may be time-domain signals. Based on first input signal, l, and the second input signal, r, the first processor 201 estimates, firstly, a power level, $P_l$, of the first input signal, l, and a power level, $P_r$, of the second input signal, r. Secondly, the first processing unit 201 estimates a maximum power level, $P_{max}$, and a minimum power level, $P_{min}$. The estimation of the maximum power level and the minimum power level corresponds to:

$$P_{max}=\max(P_l, P_r)$$

$$P_{min}=\min(P_l, P_r)$$

Wherein max( ) and min( ) are functions selecting or estimating the maximum or minimum power based on the input ($P_l$, $P_r$) to the functions.

The estimation of the maximum power level and the minimum power level may be based on a continuously computed estimate rather than a (binary) decision. This will be explained in more detail below.

The first processing unit 201 is also configured to output values, gx, of a mixing function and values, '1−gx', of a complementary mixing function. The mixing function is a function, based on e.g. the Sigmoid function or the inverse function of the tangent function, sometimes denoted A tan( ). In essence, the mixing function transitions smoothly or in multiple, discrete steps between a first limit value (e.g. '0') and a second limit value (e.g. '1') as a function of a difference between or a ratio of the power ($P_l$) of the first input signal (l) and the power ($P_r$) of the second input signal (r). An advantage is that estimation of the maximum power level and the minimum power level may be based on a continuously computed estimate rather than a (binary) decision. In some examples the mixing function is a piecewise linear function, e.g. with three or more linear segments.

The second processing unit 202 is configured to determine the first gain value (α) and the second gain value (1−α) based on the maximum power level, $P_{max}$, and the minimum power level, $P_{min}$.

Estimation of the first gain value, a, and the second gain value, '1−α', may be based on the following expression, wherein g is the difference in gain corresponding to the preset power level difference, d:

$$\alpha = \frac{\sqrt{P_{max}}}{g\sqrt{P_{max}} + \sqrt{P_{min}}}$$

Which, as desired, at least approximately satisfies the below expression, which is quadratic with respect to solving for α:

$$\frac{\alpha^2 P_{max}}{(1-\alpha)^2 P_{min}} = \frac{1}{g^2}$$

Thus, $d=20\cdot\log_{10}(1/g^2)$. In one example, $1/g^2=0.45$ corresponds to a preset power level difference, d, approximately equal to 7 dB.

It should be noted, for the sake of completeness, that the above expression, which is quadratic with respect to solving for α, can be solved conventionally, but the solution would require stationary input signals l and r, which is not generally the case for hearing devices.

The third processing unit 203 generates a value, $\alpha_n$, which iteratively converges towards the first gain value, α. Subscript 'n' designates a time-index. A value, $\beta_n$, which correspondingly iteratively converges towards the second gain value, β, is computed as $\beta_n=1-\alpha_n$ is simply computed therefrom. The third processor, recurrently computes $\alpha_n$ and $\beta_n$, e.g. at predefined time intervals e.g. one or more times pr. frame, wherein a frame comprises a predefined number of samples e.g. 32, 64, 128 or another number of samples.

Figure 3:
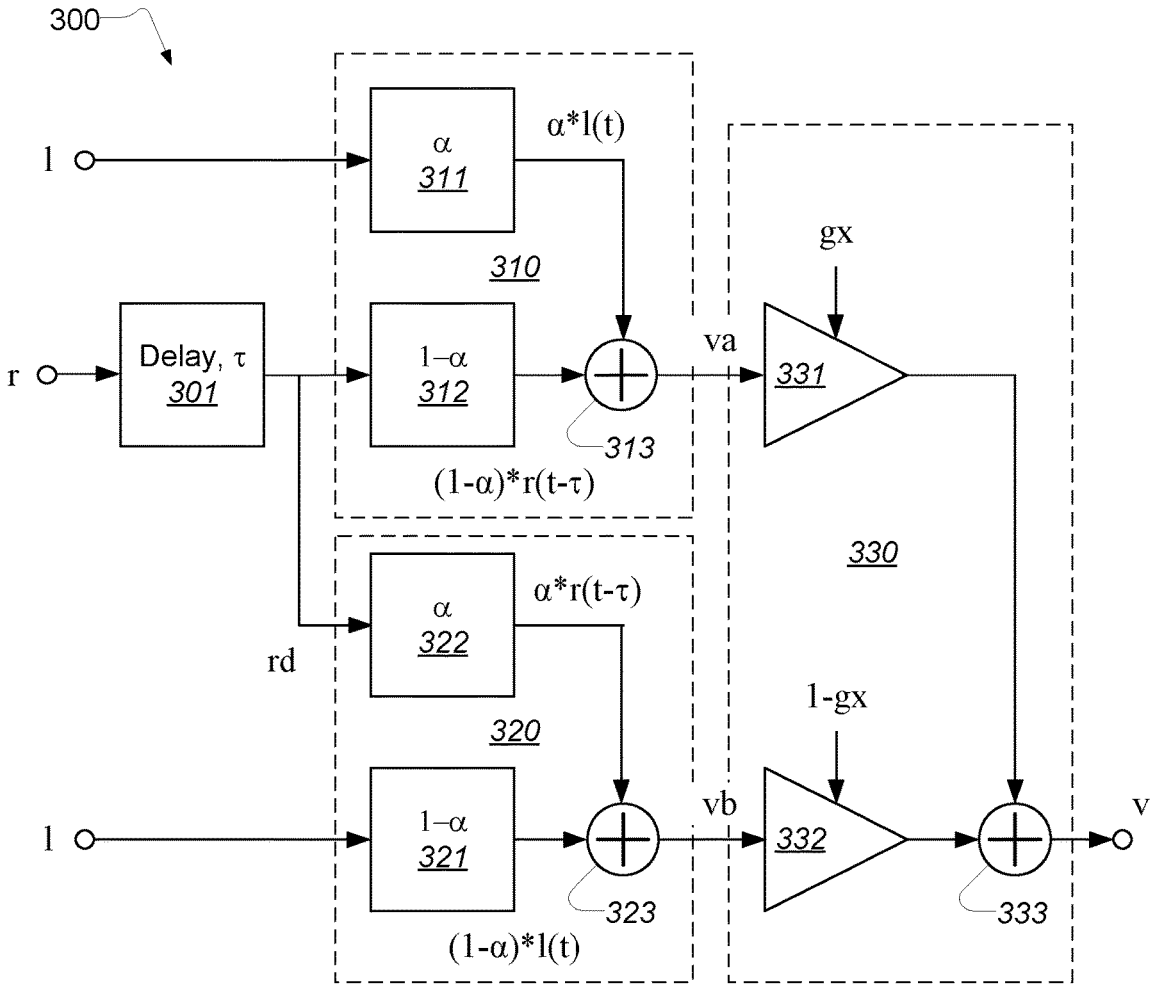
FIG. 3 shows a processing unit for performing mixing.

FIG. 3 shows a fourth processing unit for performing mixing. The fourth processing unit 300 outputs an intermediate signal, v, based on the first input signal, l, and the second input signal, r. Processing is based on the first gain value, α, or the iteratively determined value $\alpha_n$; the second gain value, β, or $\beta_n$, the value, gx, of the mixing function and values, '1−gx', of the complementary mixing function, e.g. provided by the processing units described in connection with FIG. 2.

As shown, the first input signal, l, is input to two complementary units 310 and 320, which outputs respective intermediate signals, va, and, vb to a unit 330, which mixes the intermediate signals, va, and, vb, into an intermediate signal v.

Thus, the fourth processing unit 300 provides mixing of the first input signal and the second input signal to output an intermediate signal v, which is also denoted a first intermediate signal, v. Despite being a mixer in itself, the fourth processing unit 300 includes the two complementary units 310 and 320, which are also mixers, and—further—the unit 330 which is also a mixer. The fourth processing unit 300 may thus be denoted a first mixer, the units 310 and 320 may be denoted second and third mixers, and the unit 330 may be denoted a fourth mixer. The second mixer 310 generates a second intermediate signal (va) including or based on a second weighted combination of the first input signal (l) and the second input signal, r, in accordance with the first gain value, α, and the second gain value, '1−α', respectively. The third mixer generates a third intermediate signal, vb, including or based on a third weighted combination of the first input signal, l, and the second input signal, r, in accordance with the second gain value, '1−α', and the first gain value, α, respectively. The fourth mixer generates the first intermediate signal, v, including or based on a fourth weighted combination of the second intermediate signal, va, and the third intermediate signal, vb, in accordance with a first output value, gx, and a second output value, '1−gx', based on a mixing function. The mixing function serves to implement switching based on the maximum power level, $P_{max}$, and the minimum power level, $P_{min}$. which is smooth, rather than hard to reduce artefacts. The mixing function transitions smoothly or in multiple steps between a first limit value and a second limit value as a function of a difference between or a ratio of the power, $P_l$, of the first input signal, l, and the power, $P_r$, of the second input signal, r. For instance, the mixing function is the Sigmoid function with limit values '0' and '1'. The Sigmoid function may be defined as follows:

$$S(x) = \frac{1}{1+e^x}$$

wherein x=k·ln(R), wherein $$R = \sqrt{\frac{P_l}{P_r}}$$

wherein k is a number e.g. larger than 3, e.g. 4 to 10. The value of gx is gx=S(x). Other implementations can be defined. In some aspects, for saving computational resources, the computation of S(x) may be cut off (forgone) for values of x exceeding or going below respective thresholds known to cause S(x) to assume values close to the limit values. The value gm may then be selected to assume the respective limit value or a value close to the respective limit value.

The fourth processing unit 300 implements the below expression:

$$v(t)=(gx*(\alpha*l(t)+(1-\alpha)*r(t-\tau))+(1-gx)(\alpha*r(t-\tau)+(1-\alpha)*l(t))$$

Wherein the symbol '*' designates multiplication in embodiments wherein α is implemented by a gain stage. The symbol '*' may also designate a convolution operation in embodiments wherein α is implemented by a Finite Impulse Response, FIR, filter. For the sake of simplicity, the embodiment in FIG. 3 is described as an embodiment wherein α is implemented by a gain stage.

As shown, the second signal, r, is delayed by delay unit 301 by a time delay, τ. The delay unit 301 is thus delaying the second input signal, r, relatively to the first input signal, l. The delay, τ is in the range of 3 to 17 milliseconds; e.g. 5 to 15 milliseconds. In some embodiments the delay is omitted.

The unit 310, the second mixer, comprises a gain unit 311 and a gain unit 312, to provide respective signals α*l(t) and (1−α)*r(t−τ) which are input to an adder 313, which outputs signal va.

In a mirrored way, the unit 320, the third mixer, comprises a gain unit 322 and a gain unit 321, to provide respective signals α*r(t−τ) and (1−α)*l(t) which are input to an adder 323, which outputs signal vb.

The signals va and vb are input to the unit 330, the fourth mixer. The fourth mixer comprises a gain stage 331, which weighs the signal va in accordance with the value gx, and a gain stage 332, which weighs the signal vb in accordance with the complementary value '1−gx' before the weighed signals are combined by adder 333 to provide the intermediate signal v. Thus, a smooth mixing can be implemented in a manner which is particularly suitable for a time-domain implementation. Although a time-domain implementation is preferred, it should be mentioned that the smooth mixing is also possible in a frequency domain implementation or short-time frequency domain implementation. However, for frequency domain or short-time frequency domain implementation better options may exist.

Figure 4:
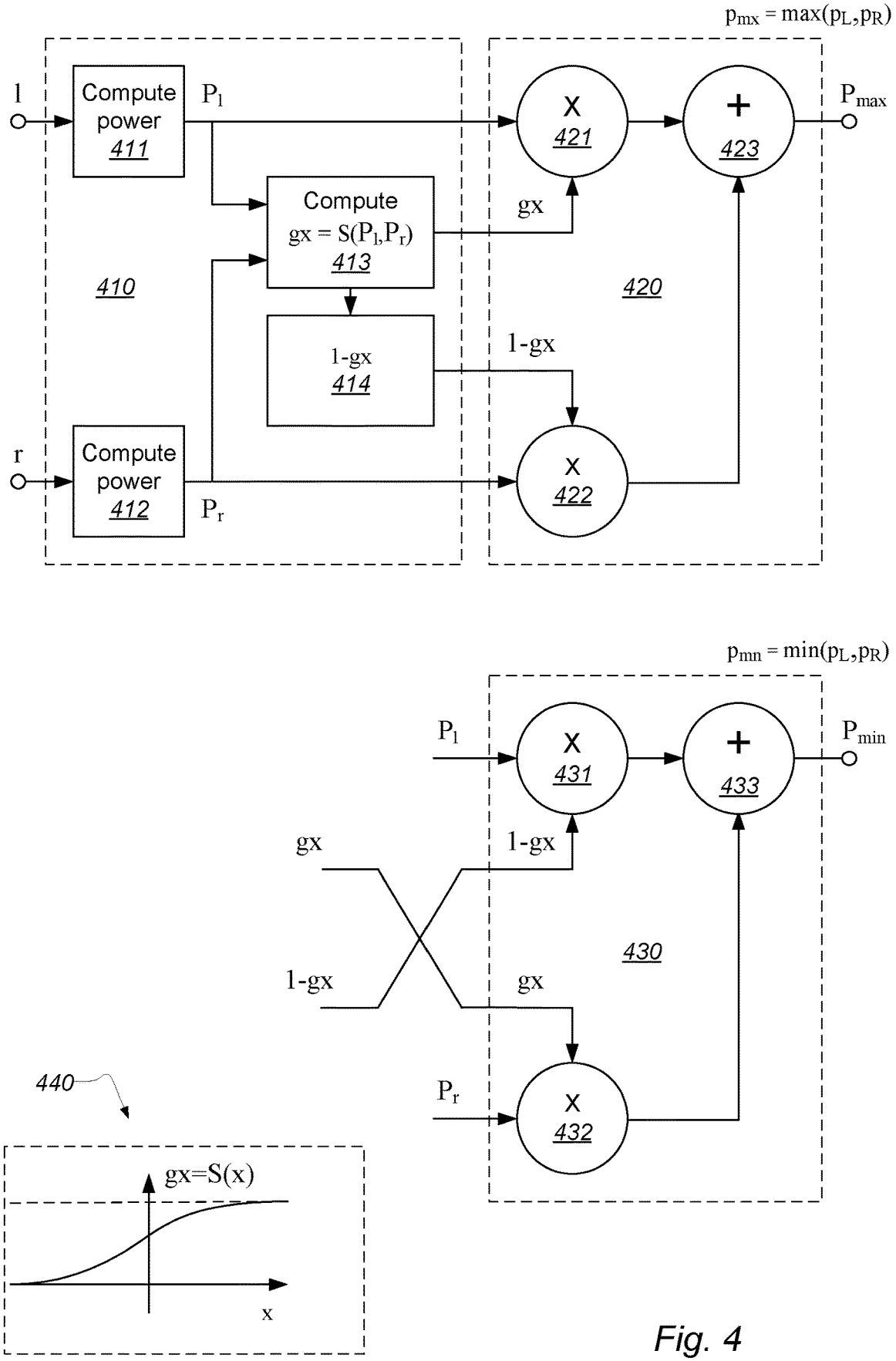
FIG. 4 shows a detailed view of the first processing unit for determining a maximum power level and a minimum power level.

FIG. 4 shows a detailed view of the first processing unit for determining the maximum power level and the minimum power level. The first processing unit utilizes the mixing function, e.g. a Sigmoid type of function, as shown at reference numeral 440, at the bottom, left hand side. From above it is recalled that x=k·ln(R), wherein $$R = \sqrt{\frac{P_l}{P_r}}$$

wherein k is a number e.g. larger than 3, at least for some embodiments.

The first processing unit receives the first input signal, l=l(t), and the second input signal r=r(t) and computes respective power levels, $P_l$ and $P_r$. The power levels may be computed recursively to obtain a smooth power estimate. The power levels may be computed using the following expressions:

$$p_L(n)=\gamma\cdot p_L(n-1)+(1-\gamma)\cdot l(n)\cdot r(n)$$

$$p_R(n)=\gamma\cdot p_R(n-1)+(1-\gamma)\cdot r(n)\cdot r(n)$$

Wherein γ is a 'forgetting factor' reflecting how much a sum of previous values should be weighted over instantaneous values. Here, n designates a time index of individual samples of the signals or frames of samples of the signals. The power levels may be computed in other ways.

Based on the computed respective power levels, $P_l$ and $P_r$, values gx of the mixing function, S( ), which may be based on a Sigmoid function, are computed by unit 413. Correspondingly, complementary values, '1−gx', are computed based on input from unit 413 in unit 414.

The respective power levels, $P_l$ and $P_r$, are weighed in accordance with the values gx of the mixing function and the complementary value '1−gx' by units 421 and 422, which may be mixers, multipliers or gain stages ora combination thereof.

A weighted sum is generated by an adder 423, which receives the respective power levels, $P_l$ and $P_r$, weighed in accordance with the values gx of the mixing function and the complementary value 1−gx'. The weighted sum is an estimate of the maximum power level, $P_{max}=\max(P_l, P_r)$. The estimate of $P_{max}$ is output by unit 420, which receives values of gm and '1−gx' from unit 410.

Also based on values of gm and '1−gx' from unit 410, albeit in a mirrored way, unit 430 outputs an estimate of the minimum power level, $P_{min}=P_r$). A weighted sum is generated by an adder 433, which receives the respective power levels, $P_l$ and $P_r$, weighed in accordance with the complementary values '1−gx' of and the value 'gx' of the mixing function.

In this way, the maximum and minimum power levels can be estimated sample-by-sample or frame-by-frame, while suppressing sudden changes, which may otherwise cause audible artefacts.

Figure 5:
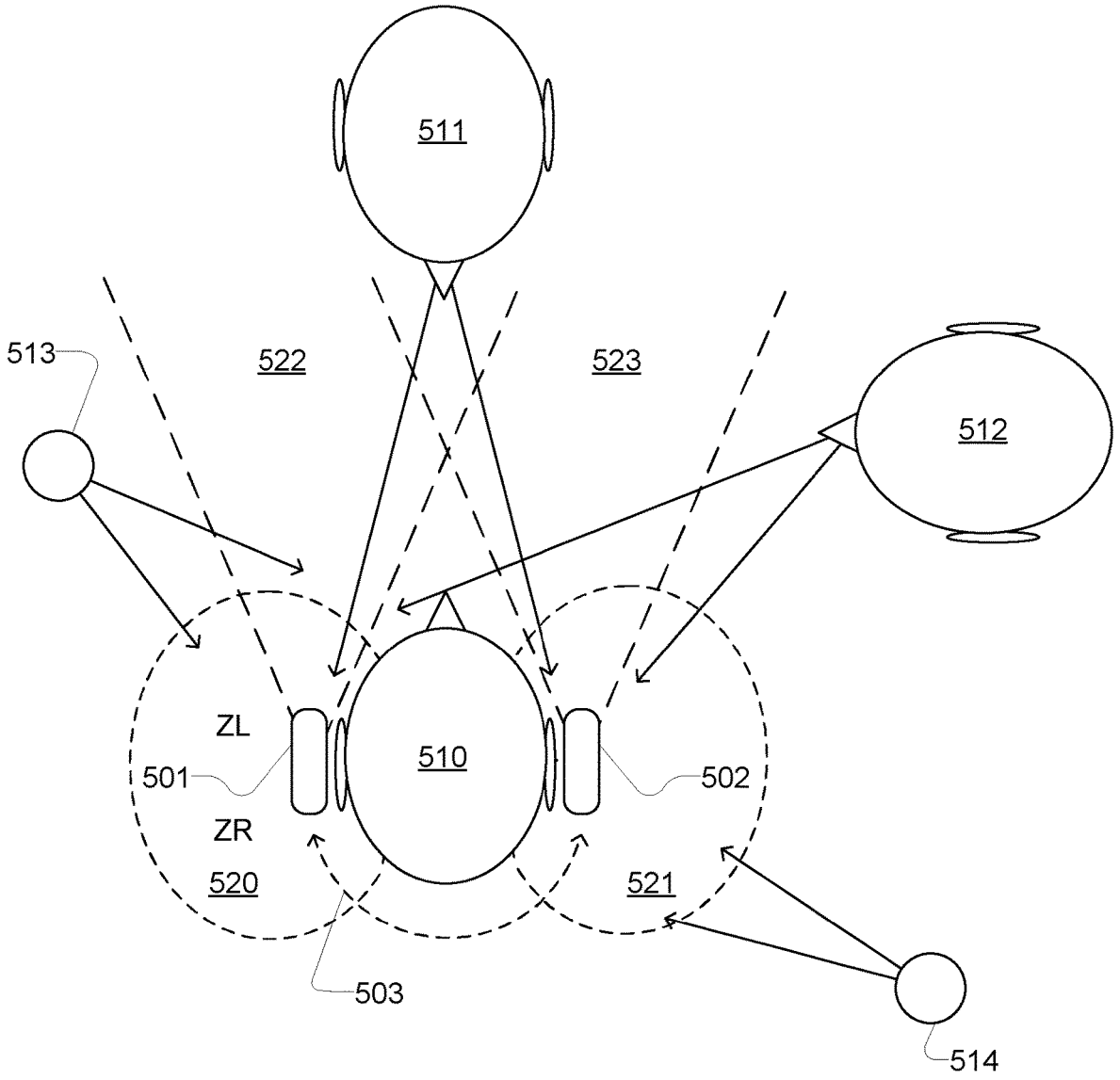
FIG. 5 shows a top-view of a human user and a first target speaker and a second target speaker.

FIG. 5 shows a top-view of a wearer of a left and a right hearing device in conversation with a first speaker and a second speaker. The wearer 510 of the left hearing device 501 and the right hearing device 502 is situated with the first speaker 511 in front (e.g. at about 0 degrees, on-axis) and the second speaker 512 to the right (e.g. at about 50 degrees, off-axis). Additionally, some audible noise sources 513 and 514 are situated about the wearer 510. The audible noise sources 513 and 514 may be anything causing sounds such as a loudspeaker, a person speaking etc.

With respect to the hearing devices, 501 and 502, the right hearing device 502 (also denoted the ipsilateral device) may be configured to provide the monitor signal to the wearer and the left hearing device 501 (also designated the contralateral device) may be configured to provide the focussed signal to the wearer 510. The hearing devices, 501 and 502, are in communication via a wireless link 503.

The ipsilateral device 502, here at the right hand side of the wearer, receives the first input signal, l, and the second input signal, r, as described herein. These signals may have, approximately, omnidirectional characteristics 520 and 521, however effectively different from an omnidirectional characteristic due to a head shadow effect caused by the wearer's head.

The contralateral device 502, here at the right-hand side of the wearer, may be configured to provide the focussed signal to the wearer. The focussed signal may be based on monaural or binaural signals forming one or more focussed characteristics 522 and 523. The focussed characteristics may be fixed, e.g. at about 0 degrees, in front of the wearer, adaptive or controllable by wearer. This is known in the art.

The first speaker 511 is on-axis, in front, of the wearer 510. Therefore, an acoustic speech signal from the first speaker 511 arrives, at least substantially, at the same time at both the ipsilateral device and the contralateral device whereby the signals are captured simultaneously. In respect of the first speaker 511, signals l and r thus have equal strength. To suppress the comb effect, it has been observed that a delay, delaying the signals 1 and r relative to each other is effective. The delay is small enough to not be perceivable as an echo.

However, the second speaker 512 is off-axis, slightly to the right, of the wearer 510. When the second speaker 512 speaks, the claimed method suppresses the signal from the first target speaker 511, who is on-axis relative to the user, proportionally to the strength of the signal received, at the ipsilateral device and at the contralateral device, from the second speaker 512, who is off-axis relative to the user. Thereby, it is possible to forgo entering an omnidirectional mode while still being able to perceive the (speech) signal from the second speaker 512. Further, the power of the first input signal, l, and the power of the second input signal, r, are reproduced to differ by the preset power level difference, d, greater than 2 dB in the weighted combination to reduce the comb effect. The comb effect is described in more detail in connection with FIG. 6.

In some situations, in the prior art, a determination that a signal is present e.g. from speaker 512 may result in a listening device switching to a so-called omnidirectional mode whereby noise sources 513 and 514 all of a sudden contribute to sound presented to the user of a prior art listening device who may be experiencing a significantly increased noise level despite the sound level of the noise sources 513 and 514 being lower than the sound level of the target speaker 512.

FIG. 6 shows a magnitude response of a monitor signal as a function of frequency. In this example, the monitor signal is designated reference numerals 604*a* and 604*b* and corresponds to the intermediate signal, v, output from the mixer 131 i.e. without post filtering and hearing loss compensation. The intermediate signal, v, is recorded for a preset power level difference of 10 dB. The magnitude response is plotted as power [dB] as a function of frequency [Hz]. The magnitude response is recorded for a sound source in front of the wearer (at look direction 0 degrees).

For comparison, a magnitude response, 603, is plotted for a signal from a front microphone (front mic) arranged towards the look direction. Correspondingly, a magnitude response, 602, is plotted for a signal from a rear microphone (rear mic) arranged away from the look direction.

Also, for comparison, a signal designated 601*a* and 601*b* is plotted for a mixer wherein the preset power level difference is about 0 dB and wherein the first gain value, α, and the second gain value, '1−α' are kept fixed e.g. ata value α=0.5.

It can be seen that the signal designated 601*a* and 601*b* at 601*a* exhibits a relatively large comb effect spanning a range of about 10 dB peak-to-peak in the frequency range of about 1000Hz to about 4000-5000 Hz.

Comparatively, the intermediate signal, v, designated by reference numerals 604*a* and 604*b* and output from the mixer 131, exhibits a suppressed, relatively smaller comb effect spanning a range less than about 3-5 dB peak-to-peak in the frequency range of about 1000 Hz to about 4000-5000 Hz.

When one or both of the first gain value, a, and the second gain value, '1−α', are determined in accordance with an objective of making the power of the first input signal, l, and the power of the second input signal, r, differ by a preset power level difference, d, greater than 2 dB in the weighted combination, the comb effect is reduced. Thus, artefacts in the intermediate signal is reduced and fidelity of the signal reproduced for the wearer can be improved.

There is also provided the following item:

1. A method performed by a first hearing device (100); the first hearing device comprising a first input unit (110) including one or more microphones (112,113) and being configured to generate a first input signal (l), a communication unit (120) configured to receive a second input signal (r) from a second hearing device, an output unit (140); and a processor (130) coupled to the first input unit (110), the communication unit (120) and the output unit (140), the method comprising:

determining a first gain value (α), a second gain value (1−α) or both of the first gain value (α) and the second gain value (1−α);

generating a first intermediate signal (v) including or based on a first weighted combination of the first input signal (l) and the second input signal (r); wherein weighing into the weighted combination is based on the first gain value (α), the second gain value (1−α), or both of the first gain value (α) and the second gain value (1−α); and generating an output signal (z) for the output unit (140) based on the first intermediate signal;

wherein one or both of the first gain value (α) and the second gain value (1−α) are determined in accordance with an objective of making the power of the first input signal (l) and the power of the second input signal (r) differ by a preset power level difference (d) greater than 2 dB in the weighted combination.

Embodiments of item 1 are set out in the claims in particular in the dependent claims 2-14 and in claims 15-16.

In some embodiments, with reference to item 1 above, the power of the first input signal (l) may be the power of the original first input signal. In other embodiments, the power of the first input signal (l) may be the power of the weighted first input signal. Also, in other embodiments in which the weighing is based on the first gain value, the power of the first input signal (l) may be the power of the gain-applied first input signal.

Similarly, in some embodiments, with reference to item 1 above, the power of the second input signal (r) may be the power of the original second input signal. In other embodiments, the power of the second input signal (r) may be the power of the weighted second input signal. Also, in other embodiments in which the weighing is based on the second gain value, the power of the second input signal (r) may be the power of the gain-applied second input signal.

Also, in some embodiments, with reference to item 1 above, the objective of making the power of the first input signal (l) and the power of the second input signal (r) differ by the preset power level difference (d) greater than 2 dB in the weighted combination, may apply when |P1−P2|<=6 dB, wherein P1 is the power of the generated first input signal, and P2 is the power of the received second input signal. In other embodiments, the objective may apply when |P1−P2|>=6 dB. In further embodiments, the objective may apply regardless of the value of |P1−P2|.

It should be appreciated that the method described herein can be implemented in different ways. However, some details may be appreciated.

In some examples, the monitor signal is generated with the aim to achieve a similar sensitivity as the binaural natural ear for surrounding, e.g. moving, sound sources, while the focus signal uses a beamformed signal.

In a time-domain implementation mixing of the left and right signals to achieve at least an approximated 'true' omnidirectional characteristic, where the mixing is generated as follows:

$$v(t)=\alpha*l(t)+(1-\alpha)*r(t-\tau)$$

Due to the head shadowing effect, the relative level between the left and right signals varies significantly as a sound source moves around the user. Further, it is desired to suppress the observed comb effect (aka. the comb filtering effect). Therefore, it is proposed to control the weighing of the signals l(t) and r(t) through the parameter α to improve the (true) omnidirectional sensitivity or Situational Awareness Index in cocktail party situations and alleviate the comb filtering effect.

The wearer's head has a little head shadow effect in low frequencies (below 500-1000 Hz) and there is no need to mix the left and right signals in low frequencies for true omnidirectional characteristic. The signals, signals l(t) and r(t) may therefore be split into a low-frequency band and a high-frequency band. Also, we can avoid the major cause of the comb filtering by skipping the mixing in the low-frequency band. This is because the human auditory system has a higher frequency resolution or narrow critical bands in low frequencies. That could make some audio sound a little harsh and sharp in anechoic chamber listening monaurally.

In the high-frequency band, when the signals coming from the front, the hearing aids received the same signals, it still could result in some combs by combining two signals. The signals from the off-axis sources will show some significant interaural level difference due to the head shadow effect. The mixing of the two signals will show a shallow comb effect.

Given the discussion above, the cross-correlation or the levels of the two signals plays an important role in achieving a shallow comb filtering effect and the Omni polar pattern. The introduction of delay is one way to reduce the cross-correlation for speech signals. More importantly, it is proposed to control the level difference between the two signals dynamically to achieve better omnidirectional sensitivity in the mixing.

The mixing parameter a is controlled adaptively.

For the mixing, $$v(n)=\alpha*(l(n)+(1-\alpha)*r(n-\tau)$$

In general, α can be treated as a FIR filter and the symbol * indicates a convolution operation.

The powers of the signals $P_l$ and $P_r$ are calculated as:

$$s_l(n) = \sum(\alpha(i))l(n-i)$$

$$s_r(n) = \sum(1-\alpha(i))r(n-i)$$

$$P_l = \sum_{n=1}^{N}\{s_l(n)\}^2$$

and $$P_r = \sum_{n=1}^{N}\{s_r(n)\}^2$$

and

A goal is to obtain the optimal α so that the power difference with a scaling constant g is minimal, i.e.

$$\underset{\alpha}{\text{Argmin}}E = \underset{\alpha}{\text{Argmin}}\{1/2(gP_l - P_r)^2\}$$

It is possible to solve a adaptively with the gradient decent method as follows:

$$\alpha_j^{m+1} = \alpha_j^m - \text{step} * \frac{\partial E}{\partial \alpha_j}$$

where $$\frac{\partial E}{\partial \alpha_j} = (gP_l - P_r)\left(g\frac{\partial P_l}{\partial \alpha_j} - \frac{\partial P_r}{\partial \alpha_j}\right)$$

$$\frac{\partial P_l}{\partial \alpha_j} = 2\sum_{n=1}^{N}\{s_l(n)\}l(n-j)$$

$$\frac{\partial P_r}{\partial \alpha_j} = 2\sum_{n=1}^{N}\{s_r(n)\}r(n-j)$$

For a one tap filter (gain stage), it is also possible to derive the mixing parameter in the following. Firstly, we compute the short-term, smoothed power of the signals as:

$$P_l = \text{forgetingFactor}*P_l+(1-\text{forgetingFactor})*(l*l)$$

$$P_r = \text{forgetingFactor}*P_r+(1-\text{forgetingFactor})*(r*r)$$

Then, we can pick a better signal between the left and right signals. Let us assume $P_l>P_r$, the level ratio in the mixing would be:

$$\frac{\alpha^2 P_l}{(1-\alpha)^2 P_r} = 1/g^2$$

Our goal is to maintain the level ratio g as a constant for the source from any direction. Therefore, $$\alpha = \frac{R}{g+R}$$

and $$R = \sqrt{\frac{P_r}{P_l}}$$

In dynamical acoustic scene, we adaptively update mixing parameter α as follows:

$$\alpha_n = \alpha_{n-1} + \text{stepSize}*(\alpha - \alpha_{n-1})$$

The stepSize may be chosen to be 0.005 and the forgetingFactor may be around 0.7. When g is 0.25, the level difference between the mixing signals is about 6 dB. If $P_l==P_r$, $\alpha_n$ will converge to $$\alpha = \frac{1}{g+1} = 0.8$$

and $(1-\alpha)=0.2$. For default fixed mixing, we set $\alpha=0.5$.

In the above, we assumed the assume $P_l>P_r$ and the parameter α is multiplied with the left signal. Vice versa, for the right signal. To avoid a binary decision to determine the maximum and minimum:

We introduce a sigmoid function to make a soft decision as follows:

$$gx = \frac{1}{1+e^{k\ln(R)}}$$

where $$R = \sqrt{\frac{P_r}{P_l}}$$

So R>>1, gx=0; and R<<1, gx=1; k is a positive constant k=4 to 10. The square root of R can be absorbed in to k;

Therefore, $P_{max}=(gx\ p_p+(1-gx)p_r$, $P_{min}=(gxp_r+(1-gx)p_l)$ $$\frac{\alpha^2 P_{max}}{(1-\alpha)^2 P_{min}} = 1/g^2$$

$$\alpha = \frac{\sqrt{P_{max}}}{g\sqrt{P_{max}}+\sqrt{P_{min}}}$$

In dynamical acoustic scenes, for each incoming block of signals, we adaptively update mixing parameter α to reach the target as follows:

$$\alpha_n = \alpha_{n-1} + \text{stepSize}*(\alpha - \alpha_{n-1})$$

The output is mixed as follows:

$$v(t) = (gx*(\alpha*l(t)+(1-\alpha)*r(t-\tau))+(1-gx)(\alpha*r(t-\tau)+(1-\alpha)*l(t))$$

Thus, at least in some aspects, there the present disclosure relates to methods of performing bilateral processing of respective microphone signals from a left ear hearing device and a right ear hearing device of a binaural hearing system and to corresponding binaural hearing systems. The binaural hearing system uses ear-to-ear wireless exchange or streaming of a plurality of monaural signals over a wireless communication link. The left ear or right ear head-wearable hearing device is configured to generate a bilaterally or monaurally beamformed signal with a high directivity index that may exhibit maximum sensitivity in a target direction, e.g. at the user's look direction, and reduced sensitivity at the respective ipsilateral sides of the left and right ear head-wearable hearing devices. The opposite ear head-wearable hearing device generates a bilateral omnidirectional microphone signal at the opposite ear by mixing a pair of the monaural signals wherein the bilateral omnidirectional microphone signal exhibits a omnidirectional response or polar pattern with a low directivity index and therefore substantially equal sensitivity for all sound incidence directions or azimuth angles around the user's head.

Generally, herein the term 'on-axis' refers to a direction, or 'cone' of directions, relative to one or both of the hearing devices at which directions the signals are predominantly captured from. That is, 'on-axis' refers to the focus area of one or more beamformer(s) or directional microphone(s). This focus area is usually, but not always, in front of the user's face, i.e. the 'look direction' of the user. In some aspects, one or both of the hearing devices capture the respective signals from a direction in front, on-axis, of the user. The term 'off-axis' refers to all other directions than the 'on-axis' directions relative to one or both of the hearing devices. The term 'target sound source' or 'target source' refers to any sound signal source which produces an acoustic signal of interest e.g. from a human speaker. A 'noise source' refers to any undesired sound source which is not a 'target source'. For instance, a noise source may be the combined acoustic signal from many people talking at the same time, machine sounds, vehicle traffic sounds etc.

The term 'reproduced signal' refers to a signal which is presented to the user of the hearing device e.g. via a small loudspeaker, denoted a 'receiver' in the field of hearing devices. The 'reproduced signal' may include a compensation for a hearing loss or the 'reproduced signal' may be a signal with or without compensation for a hearing loss. The wording 'strength' of a signal refers to a non-instantaneous level of the signal e.g. proportional to a one-norm (1-norm) or a two-norm (2-norm) or a power (e.g. power of two) of the signal.

The term 'ipsilateral hearing device' or 'ipsilateral device' refers to one device, worn at one side of a user's head e.g. on a left side, whereas a 'contralateral hearing device' or 'contralateral device' refers to another device, worn at the other side of a user's head e.g. on the right side. The 'ipsilateral hearing device' or 'ipsilateral device' may be operated together with a contralateral device, which is configured in the same way as the ipsilateral device or in another way. In some aspects, the 'ipsilateral hearing device' or 'ipsilateral device' is an electronic listening device configured to compensate for a hearing loss. In some aspects the electronic listening device is configured without compensation for a hearing loss. A hearing device may be configured to one or more of: protect against loud sound levels in the surroundings, playback of audio, communicate as a headset for telecommunication, and to compensate for a hearing loss.

Also, as used in this specification, the term "first input signal" may refer to the original first input signal, a weighted version of the first input signal, or a gain-applied first input signal, depending on the context. For example, the term "the generated first input signal" indicates that the first input signal is the original signal. As another example, the term "the first input signal in the weighted combination" (or any of other similar terms) may indicate that the first input signal is the original first input signal if the first input signal is not weighted or is weighed by a factor of 1 in the weighted combination, or may indicate that the first input signal is a weighted first input signal if it is multiplied by a weight factor in the weighted combination, or may indicate that the first input signal is a gain-applied first input signal if the original first input signal is adjusted by a gain factor in the weighted combination (in which case, the weight may be the gain factor or may be based on the gain factor).

Similarly, as used in this specification, the term "second input signal" may refer to the original second input signal, a weighted version of the second input signal, or a gain-applied second input signal, depending on the context. For example, the term "the received second input signal" indicates that the second input signal is the original signal as received by a device. As another example, the term "the second input signal in the weighted combination" (or any of other similar terms) may indicate that the second input signal is the original second input signal if the second input signal is not weighted or is weighed by a factor of 1 in the weighted combination, or may indicate that the second input signal is a weighted second input signal if it is multiplied by a weight factor in the weighted combination, or may indicate that the second input signal is a gain-applied second input signal if the original second input signal is adjusted by a gain factor in the weighted combination (in which case, the weight may be the gain factor or may be based on the gain factor).

Herein the term 'characteristic' e.g. in omnidirectional characteristic corresponds to the term 'sensitivity', e.g. in omnidirectional sensitivity.

The invention claimed is:

1. A method performed by a first hearing device, the first hearing device comprising a first input unit including one or more microphones and being configured to generate a first input signal, a communication unit configured to receive a second input signal from a second hearing device, an output unit, and a processor coupled to the first input unit, the communication unit, and the output unit, the method comprising:

determining a first gain value, a second gain value or both of the first gain value and the second gain value;

generating a first intermediate signal including or based on a first weighted combination of the first input signal and the second input signal, wherein the first weighted combination is based on the first gain value, the second gain value, or both of the first gain value and the second gain value; and generating an output signal for the output unit based on the first intermediate signal;

wherein one or both of the first gain value and the second gain value are determined in accordance with an algorithm to make a power of the first input signal when weighted in the first weighted combination and a power of the second input signal when weighted in the first weighted combination differ by a preset power level difference greater than 2 dB.

2. The method according to claim 1, wherein the preset power level difference is greater than or equal to 3 dB, 4 dB, 5 dB or 6 dB.

3. The method according to claim 1, wherein the preset power level difference is equal to or less than 6 dB, 8 dB, 10 dB or 12 dB.

4. The method according to claim 1, wherein the generated first input signal has a higher power than that of the received second input signal, and wherein in the first weighted combination, the power of the first input signal when weighted is higher than the power of the second input signal when weighted.

5. The method according to claim 1, wherein the received second input signal has a higher power than that of the generated first input signal, and wherein in the first weighted combination, the power of the second input signal when weighted is higher than the power of the first input signal when weighted.

6. The method according to claim 1, further comprising:

generating a second intermediate signal including or based on a second weighted combination of the first input signal and the second input signal in accordance with the first gain value and the second gain value, respectively;

generating a third intermediate signal including or based on a third weighted combination of the first input signal and the second input signal in accordance with the second gain value and the first gain value, respectively;

wherein the first intermediate signal is based on the second intermediate signal and the third intermediate signal in accordance with a first output value and a second output value based on a mixing function;

wherein the mixing function transitions smoothly or in multiple steps between a first limit value and a second limit value as a function of a difference between the power of the first input signal and the power of the second input signal, or as a function of a ratio of the power of the first input signal and the power of the second input signal.

7. The method according to claim 1, further comprising:

determining the power of the first input signal and determining the power of the second input signal;

determining a highest power level ($P_{max}$) based on the power of the first input signal and the power of the second input signal and based on an output value (gx) of a mixing function;

determining a lowest power level ($P_{min}$) based on the power of the first input signal and the power of the second input signal and based on a complementary output value (1-gx) of the mixing function;

wherein the mixing function transitions smoothly or in multiple steps between a first limit value and a second limit value as a function of a difference between the power of the first input signal and the power of the second input signal, or as a function of a ratio of the power of the first input signal and the power of the second input signal.

8. The method according to claim 1, wherein the power of the first input signal is based on smoothed and squared values of the first input signal; and wherein the power of the second input signal is based on smoothed and squared values of the second input signal.

9. The method according to claim 1, wherein the first gain value satisfies the below equation:

$$\frac{\alpha^2 P_{max}}{\beta^2 P_{min}} = \frac{1}{g^2}$$

wherein $p_{max}$ is the highest power level among the power of first input signal and power of the second input signal; and wherein $p_{min}$ is the lowest power level among the power of the first input signal and the power of the second input signal, $\beta=1-\alpha$ is the second gain value, and $1/g^2$ corresponds to the preset power level difference.

10. The method according to claim 1, wherein the first gain value is determined based on the following equation:

$$\alpha = \frac{\sqrt{P_{max}}}{g\sqrt{P_{max}} + \sqrt{P_{min}}}$$

wherein $p_{max}$ is the highest power level among the power of the first input signal and the power of the second input signal; $P_{min}$ is the lowest power level among the power of the first input signal and the power of the second input signal; and g is a gain factor corresponding to the preset power level difference.

11. The method according to claim 1, further comprising recurrently, at least at a first time and a second time, determining a current value ($\alpha_n$) of the first gain value, wherein the current value ($\alpha_n$) of the fist gain value is determined iteratively in accordance with:

an estimate of the first gain value satisfying the objective of making the power of the first input signal when weighted and the power of the second input signal when weighted differ by the preset power level difference greater than 2 dB in the first weighted combination, and a previous value ($\alpha_{n-1}$) of the first gain value plus an iteration step value which is based on the estimate of first gain value and the previous value ($\alpha_{n-1}$).

12. The method according to claim 1, further comprising delaying one the first input signal and the second input signal to delay the first input signal relative to the second input signal, or to delay the second input signal relative to the first input signal.

13. The method according to claim 1, further comprising recurrently determining the first gain value, the second gain value, or both of the first gain value and the second gain value, based on a non-instantaneous level of the first input signal and a non-instantaneous level of the second input signal.

14. The method according to claim 1, wherein the first gain value and the second gain value are recurrently determined, subject to a constraint that the first gain value and the second gain value sums to a predefined time-invariant value.

15. The method according to claim 1, further comprising processing the intermediate signal to perform a hearing loss compensation.

16. A hearing device, comprising:

a first input unit including one or more microphones;

a communication unit;

an output unit comprising an output transducer;

at least one processor coupled to the first input unit, the communication unit, and the output unit; and a memory storing at least one program, the at least one program including instructions for causing the at least one processor to perform the method of claim 1.

17. A non-transitory computer readable storage medium storing at least one program, the at least one program comprising instructions, which, when executed by a processor of a hearing device, enable the hearing device to perform the method of claim 1.

* * * * *